US007757844B2

(12) United States Patent
Mobley

(10) Patent No.: US 7,757,844 B2
(45) Date of Patent: Jul. 20, 2010

(54) ARTICLE DISPLAY AND METHOD OF USE THEREOF

(76) Inventor: Tammy J. Mobley, 1090 Corinth-Poseyville Rd., Bremen, GA (US) 30110

( * ) Notice: Subject to any disclaimer, the term of this patent is extended or adjusted under 35 U.S.C. 154(b) by 647 days.

(21) Appl. No.: 11/639,730

(22) Filed: Dec. 14, 2006

(65) Prior Publication Data

US 2007/0144921 A1 Jun. 28, 2007

Related U.S. Application Data

(63) Continuation-in-part of application No. 11/337,991, filed on Jan. 24, 2006, now abandoned.

(60) Provisional application No. 60/595,514, filed on Jul. 12, 2005, provisional application No. 60/594,065, filed on Mar. 8, 2005.

(51) Int. Cl.
*A45C 11/04* (2006.01)

(52) U.S. Cl. ..... 206/6.1; 206/566; 206/818

(58) Field of Classification Search ..... 206/6.1, 206/566, 818, 459.5; 434/386; 53/443
See application file for complete search history.

(56) References Cited

U.S. PATENT DOCUMENTS 1,096,616 A * 5/1914 Feuerstein ..... 206/459.5
3,482,780 A 12/1969 Bushey
4,043,477 A 8/1977 Deese
4,907,704 A 3/1990 Souders
5,009,333 A 4/1991 Souders
5,377,820 A * 1/1995 Christman ..... 206/6.1
5,649,625 A 7/1997 Ovadia
5,677,507 A 10/1997 Becker et al.
6,059,115 A 5/2000 Ovadia
6,078,557 A 6/2000 Pierson
6,244,431 B1 6/2001 VanFleet
6,673,409 B1 * 1/2004 Wheatley ..... 428/40.1
6,866,143 B2 3/2005 Ovadia
6,959,890 B1 11/2005 Breitinger
2004/0031702 A1 * 2/2004 Mangano ..... 206/6.1
2005/0269216 A1 * 12/2005 Ovadia ..... 206/6.1

* cited by examiner

*Primary Examiner*—Luan K Bui
(74) *Attorney, Agent, or Firm*—Woodcock Washburn LLP

(57) ABSTRACT

An article display and method of use thereof, comprising a magnetic article display for releasably attaching two or more jewelry displays together or to a platform, to provide an article display set, wherein any display can be easily separated from the article display set; thereby providing for individual viewing of the removed article display and/or rearrangement of the remaining article displays within the article display set.

20 Claims, 4 Drawing Sheets

ARTICLE DISPLAY AND METHOD OF USE THEREOF

PRIORITY CLAIM TO RELATED US APPLICATIONS

To the full extent permitted by law, the present non-provisional patent application is a continuation-in-part of and hereby incorporates by reference and claims priority to and the benefit of U.S. Non-Provisional patent application entitled "Article Display and Method of Use Thereof," filed on Jan. 24, 2006, having assigned Ser. No. 11/337,991 now abandoned (which claims priority to Ser. Nos. 11/266,640, 11/252,534, 60/595,514, and 60/594,065); U.S. Non-Provisional patent application entitled "Slip Free Article Displays," filed on Nov. 3, 2005, having assigned Ser. No. 11/266,640 (which claims priority to Ser. Nos. 11/252,534, 60/595,514, and 60/594,065); U.S. Non-Provisional patent application entitled "Slip Free Article Displays," filed on Oct. 18, 2005, having assigned Ser. No. 11/252,534 (which claims priority to 60/595,514, and 60/594,065); U.S. Provisional patent application entitled "Separating Ring Tray Module," filed on Jul. 12, 2005, having assigned Ser. No. 60/595,514; and; U.S. Provisional patent application entitled "Slip Free Jewelry Displays," filed on Mar. 8, 2005, having assigned Ser. No. 60/594,065.

TECHNICAL FIELD

The present invention relates generally to display devices, and more specifically to individual jewelry display modules for storing and displaying jewelry.

BACKGROUND OF THE INVENTION

Displays are commonly used to present articles in a manner that enhances the overall aesthetic appearance and artistic presentation of the articles and thereby entices consumers to purchase same. Additionally, display cases, lighting, mirrors, display forms, and the like are often used in combination to display articles in a fashion that stimulates imagination and thus, enables the consumer to envision himself using and/or enjoying the article.

For instance, jewelry articles, particularly rings, are often stored and displayed in a variety of fancy trays, holders, or racks. The most common type of ring display comprises a square or rectangular frame, typically made of plastic, rubber, or foam, and covered by a rich-textured or luxurious fabric sheet, such as linen, velvet, flock, faux leather (VIENNA), faux suede, silk, or burlap. Further, the jewelry display may be provided with one or more recesses or slits into which a ring may be inserted and generally configured such that the band of a ring is retained therein. Another common ring display is a ring post having a tapered cylindrical shape that simulates a finger, wherein a ring may be slid over the tapered post until securely held in place.

When such ring displays are in use, a salesperson will often remove and return various displays from a display case in order to present selected rings to an enthused consumer for closer inspection. During such inspection, the sales person or consumer will often remove the ring from its individual display position, and thereafter, upon completing inspection, return the ring to its individual display position. Accordingly, over time, such repeated and continued removal and return of the ring results in the outer surface of the jewelry display fraying; that is, the thin outer fabric tends to separate from the underlying jewelry display form, so as to exhibit a fringe or worn appearance. As a result, each recess, slit, edge, or surface in the thin fabric sheet detaches from the underlying display frame and/or wears away. Furthermore, such repeated use and activity causes ring-retaining recesses or slits formed within the frame to expand or stretch. Consequently, slits are no longer able to stably hold or securely retain a ring therewith, and/or fail to maintain the ring at an aesthetically pleasing angle, thus, significantly detracting from the overall product appearance.

Furthermore, upon selling a ring from a ring display, a sales person must rearrange the remaining rings or insert a replacement ring into the open recess, slit, or ring post, requiring expended time and effort. In addition, if a multiple ring display is in use, and a replacement ring is not available to fill an open recess, slit, or ring post, such a vacancy may detract from the general harmony and aesthetic appearance of the jewelry display, and may potentially causing a consumer to focus on the vacant recess, slit, or post, rather than the remaining rings displayed. To prevent such distraction, a sales person must remove each of the rings from the ring display, and rearrange them in a different display having an appropriate number of receptacles, which is very time consuming.

Therefore, for the foregoing reasons, it is readily apparent that there is a need for an article display and method of use thereof, wherein the convenient and repeated removal and replacement of a ring is enabled without fraying of the jewelry display, and/or without causing additional wear and deterioration to the jewelry display. There is a further need for a jewelry display that disposes with the burdensome task of rearranging the remaining jewelry items within a jewelry display, to fill a vacant recess, slit, or ring post presented after selling or otherwise removing an individual jewelry piece from the display set, such that rings or other articles may be quickly and easily rearranged within the display if an article is removed from the display.

SUMMARY OF THE INVENTION

Briefly described in a preferred embodiment, the present invention overcomes the above-mentioned disadvantages and meets the recognized need for such an invention by providing an article display and method of use thereof, wherein a magnetic article display releasably attaches two or more article displays together, thus, creating a article display set, and wherein any article display can be easily separated from the article display set, thereby providing for individual viewing of the removed article display and/or providing for convenient rearrangement of the remaining article displays within the article display set.

According to its major aspects and broadly stated, the present invention in its preferred form is an article display and method of use thereof, comprising a display platform and a magnetic material operably connected thereto.

More specifically, the preferred embodiment of the present invention is an article display and method of use thereof, comprising a plurality of article displays covered in a suitable material, wherein individual article display units may be removably attached to other article display units and/or to a display platform, in essentially any selected configuration, thereby forming an article display set. Each article display preferably comprises one or more magnetic portions that may be brought into magnetic attracted contact with one or more magnetic portions of another article display or of a display platform. As such, any article display in the set can be temporarily removed and/or magnetically re-attached to one or more other article displays of the set, or to the display platform. Additionally, the magnetic material of each article display facilitates repeated removal of the articles from a case for viewing, without risk of fraying the article display, or of causing additional wear and deterioration to the article display, and without requiring removal of the article from the article display for viewing.

Accordingly, a feature and advantage of the present invention is its ability to expedite article-handling processes by reducing or eliminating the time needed to remove and/or insert an article into a fixed article display set by providing an individual article display unit, wherein each article display unit releasably attaches to other article display units or the display platform, together forming an article display set.

Still another feature and advantage of the present invention is its ability to expedite article retraying processes following removal of a single article from a fixed article display set by providing an individual article display unit, wherein each article display unit releasably attaches to other article display units or the display platform, forming an adjustable article display set.

Still another feature and advantage of the present invention is its ability to eliminate vacant slots in a removable article display set by providing removable and reconfigurable article display units that do not require removal of the article from the display for viewing, but instead enable the removal of a display unit with the article displayed therein for viewing.

Still another feature and advantage of the present invention is its ability include a plurality of article display units arranged together while retaining the appearance of a traditional display.

Still another feature and advantage of the present invention is its ability to separate an article display unit from the article display set and rearrange the remaining article display units, thereby leaving the remaining articles in place for continued display.

Still another feature and advantage of the present invention is its ability to add an article display unit to an article display set without necessitating removal of the entire article display set from the display case, or rearrangement of the article in a different article display.

Still another feature and advantage of the present invention is its ability to accommodate a variable number of articles by facilitating addition or removal of article display units from an article display set.

Yet another feature and advantage of the present invention is its ability to work in conjunction with a high-friction surface platform for retaining and displaying articles in article display units and articles displayed directly on the display platform.

Yet another feature and advantage of the present invention is its ability to releasably attach article display units to other article display units or a platform without attracting unwanted debris and dust.

Yet another feature and advantage of the present invention is its ability to provide an article display set including releasably attached article display units that maintains the appearance of a traditional article display, and that can be integrated seamlessly into a display case containing conventional article displays.

Yet another feature and advantage of the present invention is its ability to quickly alert a merchant to the absence of an article or an article display unit.

Yet another feature and advantage of the present invention is its ability to provide article display units which are releasably attachable to conventional article display platforms to form an article display including various different types of articles.

Yet another feature and advantage of the present invention is its ability to be re-organized when an article is removed from the article display set for display or when an article from the set is sold.

Yet another feature and advantage of the present invention is its ability to releasably retain at least one of a plurality of labels, logos, signs, pictures or other symbol appropriate to identify or convey other information about articles on display, and to change the labels as the articles are changed.

These and other features and advantages of the present version of the invention will become more apparent to one skilled in the art from the following description and claims when read in light of the accompanying drawings.

BRIEF DESCRIPTION OF THE DRAWINGS

The present version of the invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE INVENTION

In describing the preferred and selected alternate embodiments of the present invention, as illustrated in FIGS. 1-6, specific terminology is employed for the sake of clarity. The invention, however, is not intended to be limited to the specific terminology so selected, and it is to be understood that each specific element includes all technical equivalents that operate in a similar manner to accomplish similar functions. In particular, the term "magnet" is intended to include permanent magnetic materials, induced magnetic materials, electromagnets, and any other material capable of magnetically attracting another material.

Figure 1:
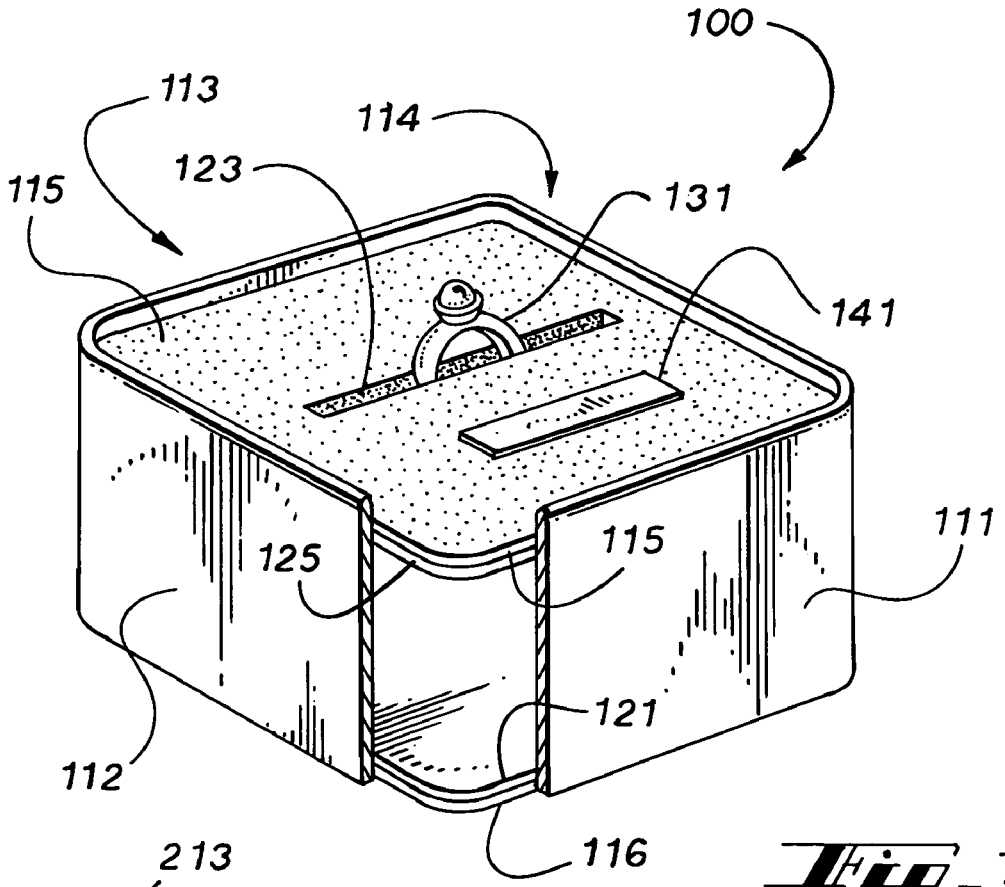
FIG. 1 is a partial cut-away perspective view of an article display unit according to a preferred embodiment of the present invention.

Referring now to FIG. 1, by way of example, and not limitation, there is illustrated a partial cut-away perspective view of article display unit 100. Preferably, article display unit 100 comprises sides 111, 112, 113, and 114, top 115, and bottom 116 arranged in a cube. Sides 111, 112, 113, and 114, top 115, and bottom 116 are preferably formed of a suitable material, such as wood, plastic, metal, cardboard, rubber, foam, or the like, capable of providing-structure to article display unit 100. Preferably, the material includes other suitable characteristics, such as a variety of forms and shapes, durability, water-resistance, light weight, heat-resistance, chemical inertness, oxidation resistance, ease of workability, or other beneficial characteristic understood by one skilled in the art. Sides 111, 112, 113, and 114, top 115, and bottom 116 preferably include a rich-textured or luxurious fabric sheet, such as linen, velvet, flock, faux leather (VIENNA), faux suede, silk, burlap, or the like, or a high friction material, such as a soft rubber or polymer, and an adhesive, or the like covering an exterior surface.

Bottom 116 preferably includes a magnetic element, such as magnet 121 capable of providing sufficient attractive force when brought near a ferromagnetic material to removably retain article display unit 100 in a fixed position with respect to the ferromagnetic material. Magnet 121 is preferably attached to a surface of bottom 116 or disposed within bottom 116, or bottom 116 may optionally consist entirely of magnet 121. Top 115 preferably includes an article retaining structure, such as groove 123, capable of releaseably retaining an article, such as ring 131, in a desired position. Additionally, top 115 further preferably includes magnetic material 125, such as a magnet or a ferromagnetic material, disposed proximate an interior surface of top 115. Magnetic material 125 is preferably attached to the interior surface of top 115, but may alternatively be disposed within top 115, or top 115 may consist entirely of magnetic material 125.

Magnetic material 125 preferably works in conjunction with label 141, which preferably includes a magnet or ferromagnetic material, to secure label 141 to top 115 such that it is visible to a customer. In use, a selected one of a plurality of labels 141 may preferably be removably attached to article display unit 100 in order to convey information to a consumer about an article retained therein, such as a manufacturer, size, weight, cost, or other information. Since the labels are removable, article display unit 100 may be used to display one article identified or characterized by a first label at a first time, and may subsequently be used to display an article of another catagory identified or characterized by a second label at a second time.

Figure 2:
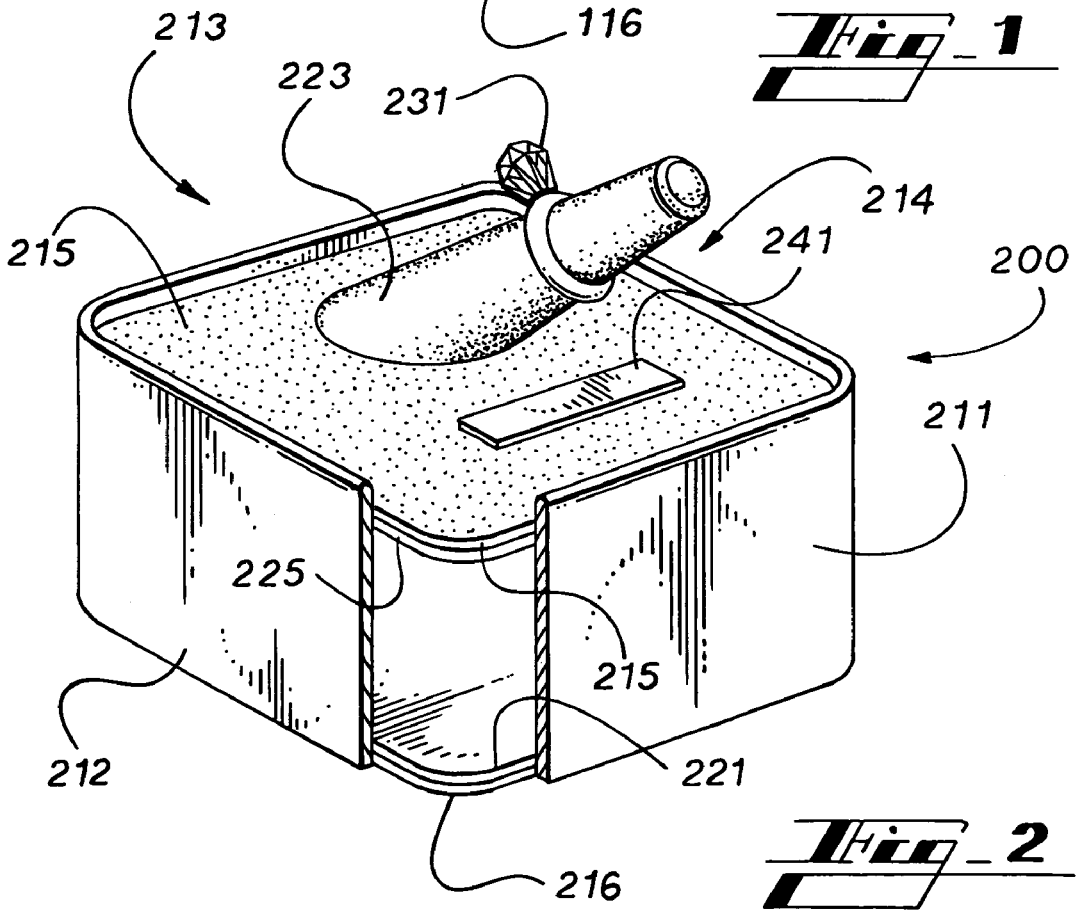
FIG. 2 is a perspective view of an article display unit according to an alternative embodiment of the present invention.

Now referring to FIG. 2, article display unit 200 according to an alternative embodiment of the present invention is similar to article display unit 100 and includes sides 211, 212, 213, and 214, top 215, and bottom 216. Sides 211, 212, 213, and, 214, top 215, and bottom 216 may optionally include high friction surface fabric disposed over or placed thereon, or may be constructed of a material having a high friction surface. Magnet 221 is preferably disposed on at least a portion of bottom 216, but bottom 216 may optionally be a magnet. Top 215 preferably includes magnetic material 225, such as a magnet or a ferromagnetic material, disposed proximate an interior surface of top 215. Magnetic material 225 is preferably attached to the interior surface of top 215, but may alternatively be disposed within top 215, or top 215 may consist entirely of magnetic material 225. As with the preferred embodiment described hereinabove, magnetic material 225 preferably works in conjunction with label 241, which preferably includes a magnet or ferromagnetic material, to removably secure label 241 to top 215, such that it is visible to a customer. In use, a selected one of a plurality of labels may preferably be removably attached to article display unit 200 in order to convey information to a consumer about an article retained therein, such as a manufacturer, size, weight, cost, or other information. Thus, different labels may be used with a given article display 200 at different times in conjunction with different types or styles of articles displayed in article display 200 at the different times.

Article display unit 200 differs from article display unit 100 primarily in that top 215 alternatively includes a different article retaining structure than groove 131, such as tapered cylinder 223, capable of retaining an article, such as ring 231, in a desired "simulated wear" position. Article display unit 200 is preferably made having identical dimensions as article display unit 100 such that article display units 200, 100 of various configurations may be arranged proximate one another in a display set without difficulty in selecting an arrangement due to differences in dimensions. Alternatively, however, according to certain embodiments, one or more article display unit may be made having dimensions differing from other display units in order to display articles of various sizes and types, such as, watches, necklaces, bracelets, pens, pendants, broaches, cuff links, coins, sculptures, body-piercing jewelry, or any other article for display, or simply to add interest to the display set, such as by varying a height of the article display units in the article display set.

Figure 3A:
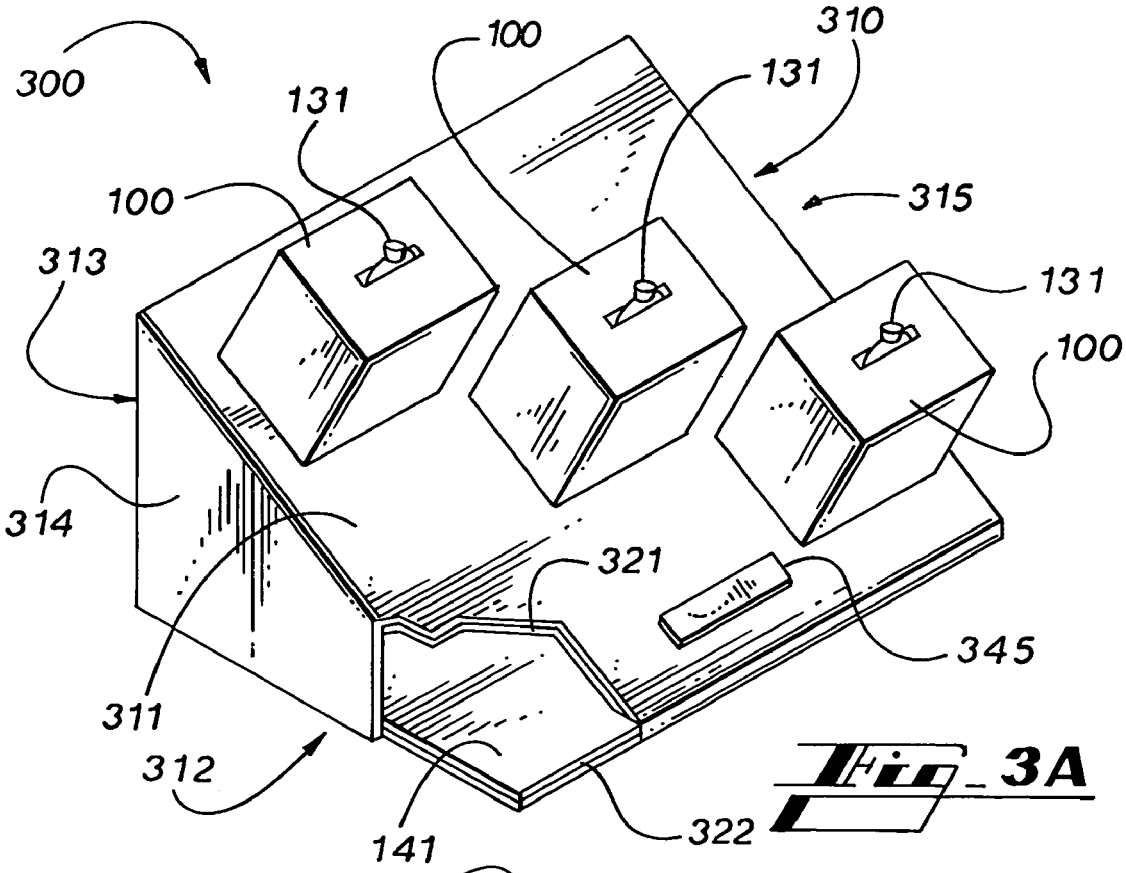
FIG. 3A is a partial cut-away perspective view of an article display platform according to a preferred embodiment of the invention showing a plurality of article display units thereon.

Referring now to FIG. 3A, article display set 300 preferably includes article display platform 310 and a plurality of article display units 100. Article display platform 310 is preferably wedge shaped and includes top 311, bottom 312, back 313, and sides 314, 315. Optionally, article display set 300 may additionally or alternatively include various article display units according to various configurations, including article display units 200 or conventional article display units, and such additional or alternative article display units may or may not include a magnet. Preferably, article display set 300 has the appearance of being a single display tray, and may appear to be a single conventional tray.

According to the preferred embodiment, and as shown in FIG. 3A, each of article display units 100 includes a magnet such that an attractive force sufficient to releasably retain article display units 100 to ferromagnetic material 321, 322 of article display platform 310. In order to provide for releasably retaining conventional article displays not including a magnet, article display platform may optionally be covered with or otherwise include a high friction material. According to a preferred embodiment, article display platform 310 includes a ferromagnetic structure, although a non-ferromagnetic structure may be used in an alternative embodiment provided that a ferromagnetic material is included on, or integrally formed with, preferably at least top 311, and preferably also included on, or integrally formed with, bottom 312. Article display set 300 preferably further includes label 345 which includes at least a magnetic portion. Label 345 preferably includes text or symbols adapted to convey information to a consumer about each of a plurality of articles displayed in article display set 300, such as a common manufacturer, size, weight, cost, or other common characteristic among the articles. Since the labels are removable, article display set 300 may be used to display a plurality of articles having a common characteristic identified or described by a first label at a first time, and may subsequently be used to display a plurality articles having a second common characteristic identified or described by a second label at a second time.

For example, article display set 300 may include a plurality of article display units 100, 200, each containing a different respective article of ruby jewelry. At such time each of the plurality of article display units 100, 200 would preferably include a respective label 141, 241 describing the respective article, such as price, weight, quality, etc. and article display set 300 would preferably include label 345 describing the common characteristic of each article. If the exemplary ruby articles were replaced with engagement rings, for example, labels 141, 241 could preferably be replaced with appropriate other labels 141, 241 describing the replacement articles, i.e. the engagement rings, respectively. Furthermore, label 345 would preferably be replaced with another label 345 indicating the new common characteristic. If any of the exemplary engagement rings is sold, it may be replaced, or the respective one of article display units 100, 200 may be removed, and the remaining ones rearranged to create an attractive display set.

In use, article display platform 310 may preferably be arranged resting on bottom 312 with top 311 facing a customer or shopper. Article display units 100, or others, may preferably be arranged on top 311 according to a desired configuration, for displaying articles, such as rings 131. Magnets 121 of article display units 100 preferably provide sufficient attractive force to retain article display units 100 in the desired configuration, even if article display platform 310 is moved. Thus, when a customer or shopper expresses interest in a particular article, the article display unit retaining the article may be removed from the article display platform for handling and/or viewing by the customer or shopper. When the customer or shopper is finished handling and/or viewing the article, the article display unit may be returned to the article display case and may be replaced on the article display platform. Article display units 100 are preferably interspersed or otherwise arranged on top 311 for retaining articles, such as rings 131, for display. Label 345 is likewise preferably arranged on top 311 where it is visible to the customer or shopper and can be used to provide information about the articles displayed in the various article display units.

Figure 3B:
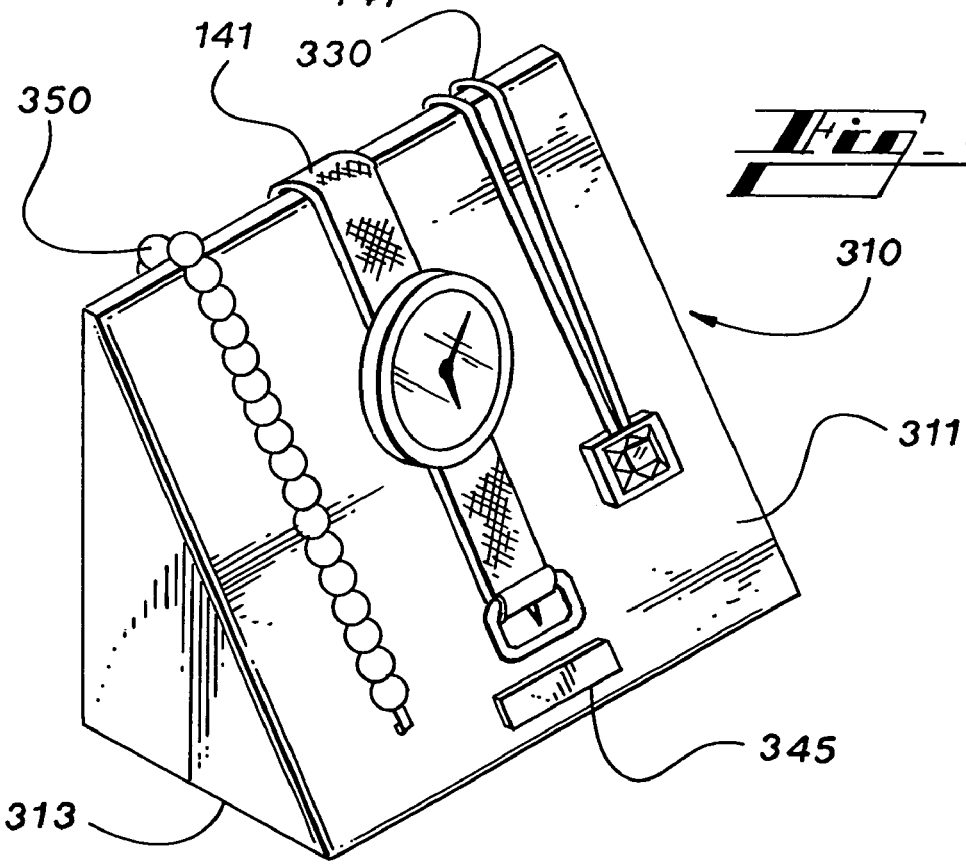
FIG. 3B is a perspective view of the article display platform of FIG. 3A according to an alternative configuration of the present invention.

Article display platform 310 may, alternatively, be used by placing article display platform 310 on back 313 with top 311 facing a customer or shopper, as is shown in FIG. 3B. When used in the arrangement of FIG. 3B, article display platform 310 preferably includes a high-friction or tacky material disposed on or forming top 311. Articles, such as bracelet 330, watch 340, and necklace 350, or the like, are preferably displayed directly on top 311, and retained thereon by the high friction or tacky material such that movement of article display platform 310, such as removal from a display case, does not disturb the articles from their respective positions. Label 345 may also preferably be arranged on top 311 to provide information about the articles displayed thereon.

Article display platform 310 is preferably constructed of ferromagnetic material, but may optionally be formed or a polymeric material, as plastic offers a variety of forms and shapes; additionally, other suitable materials such as cardboard, foam, wood, aluminum, or the like, can be utilized, provided such material has sufficient strength and/or durability as would meet the purpose described herein and provided a ferromagnetic material is included near top 311, and optionally other surfaces, such that article display units 100 are removably retained by an interaction between magnet 121 and the ferromagnetic material.

Figure 4:
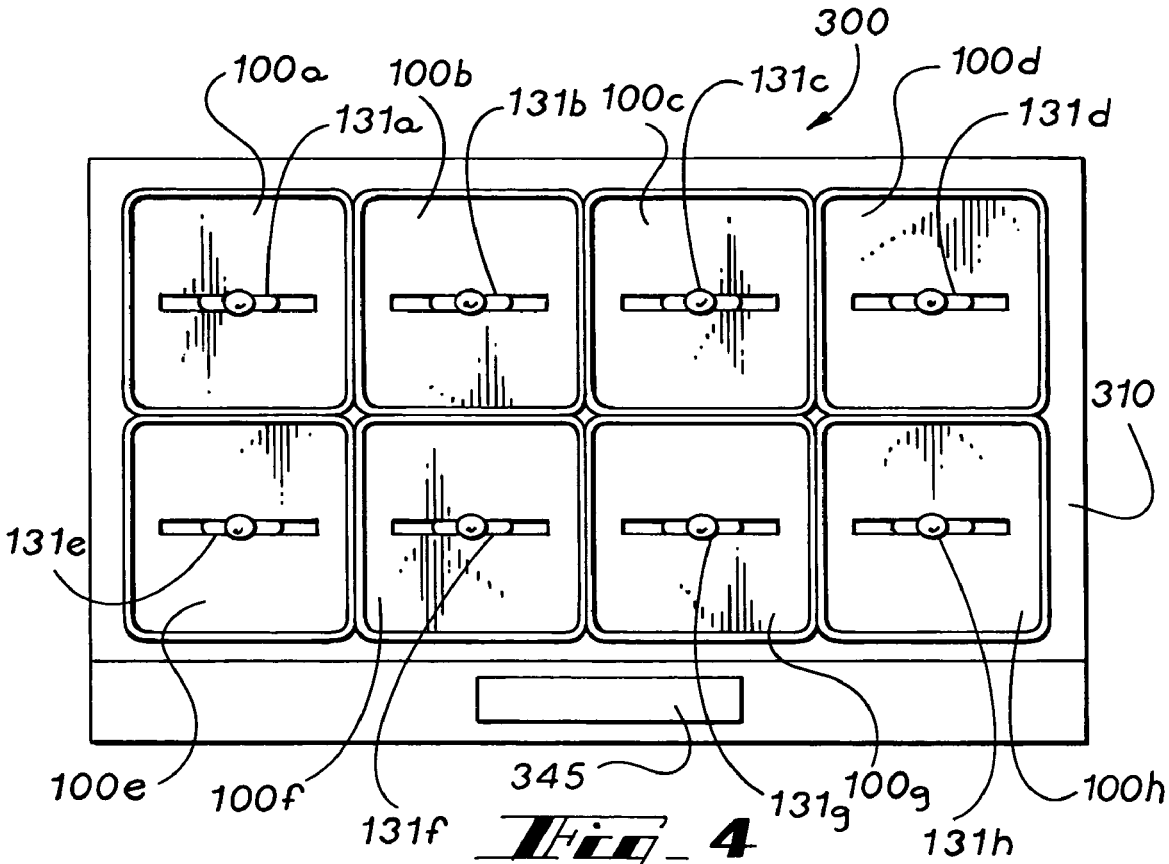
FIG. 4 is a top view of an article display set in accordance with a preferred embodiment of the present invention showing a first arrangement and configuration of a plurality of article display units.

Referring now to FIG. 4, there is illustrated a top view of an eight-unit grouping of article display units 100*a*, 100*b*, 100*c*, 100*d*, 100*e*, 100*f*, 100*g*, and 100*h*, arranged in a grid configuration (i.e., rows and columns). As illustrated in FIG. 4, a plurality of article display units 100 can be releasably attached to article display platform 310 to form article display set 300. While platform 310 is shown as having a rectangular perimeter, other shapes are contemplated, including circular, oval, heart, and diamond, among other perimeter shapes. Platform 310 should be sized such that a desired number of display units may preferably be arranged in a plurality of configurations, depending on the appearance of the presentation desired, and depending on the number and style of the display units, and should preferably provide room for the additional placement of one or more labels or signs.

Figure 5:
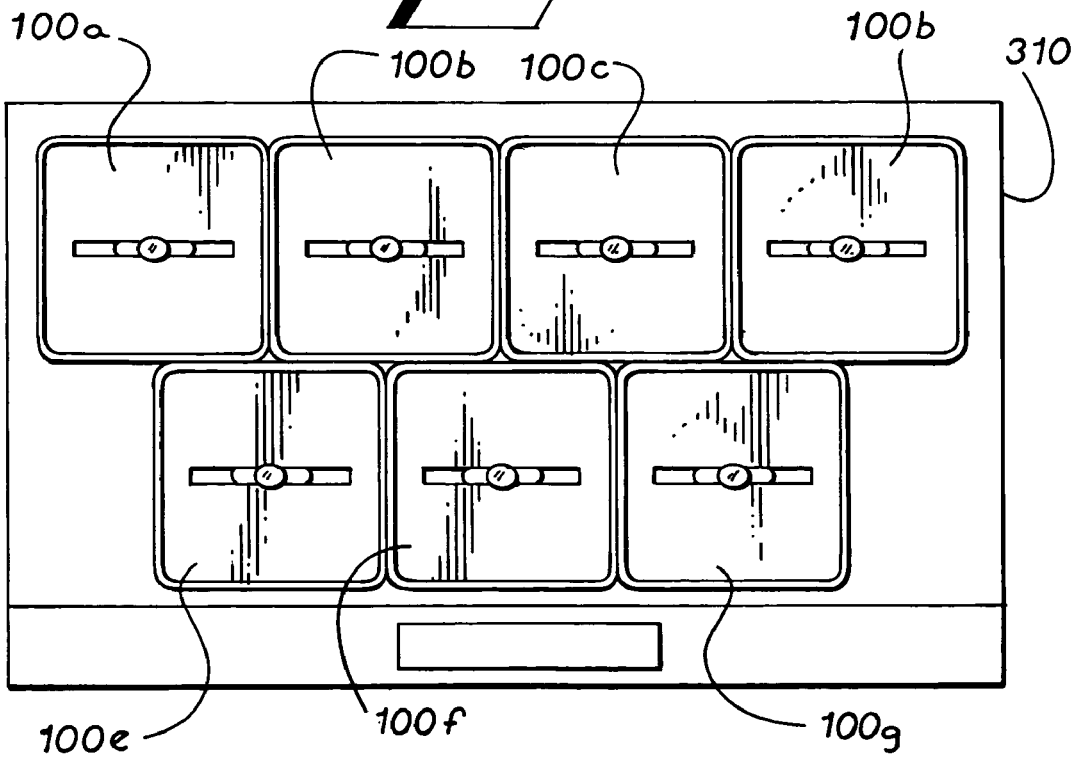
FIG. 5 is a top view of the article display set of FIG. 4 illustrating the individual article display units of the article display set in a second, rearranged configuration after the removal of an individual article display unit.

Referring now to FIG. 5, there is illustrated a top view of a seven-unit grouping of article display units 100, comprising units 100*a*, 100*b*, 100*c*, 100*d*, 100*e*, 100*f*, and 100*g* in a grid configuration (i.e., rows and columns). As illustrated in FIG. 5, a plurality of article display units 100 can be releasably adhered to article display platform 310 to form article display set 300. The seven-unit configuration may be used, for example, in the event that one of the article display units is removed from the eight-unit configuration of FIG. 4.

Figure 6:
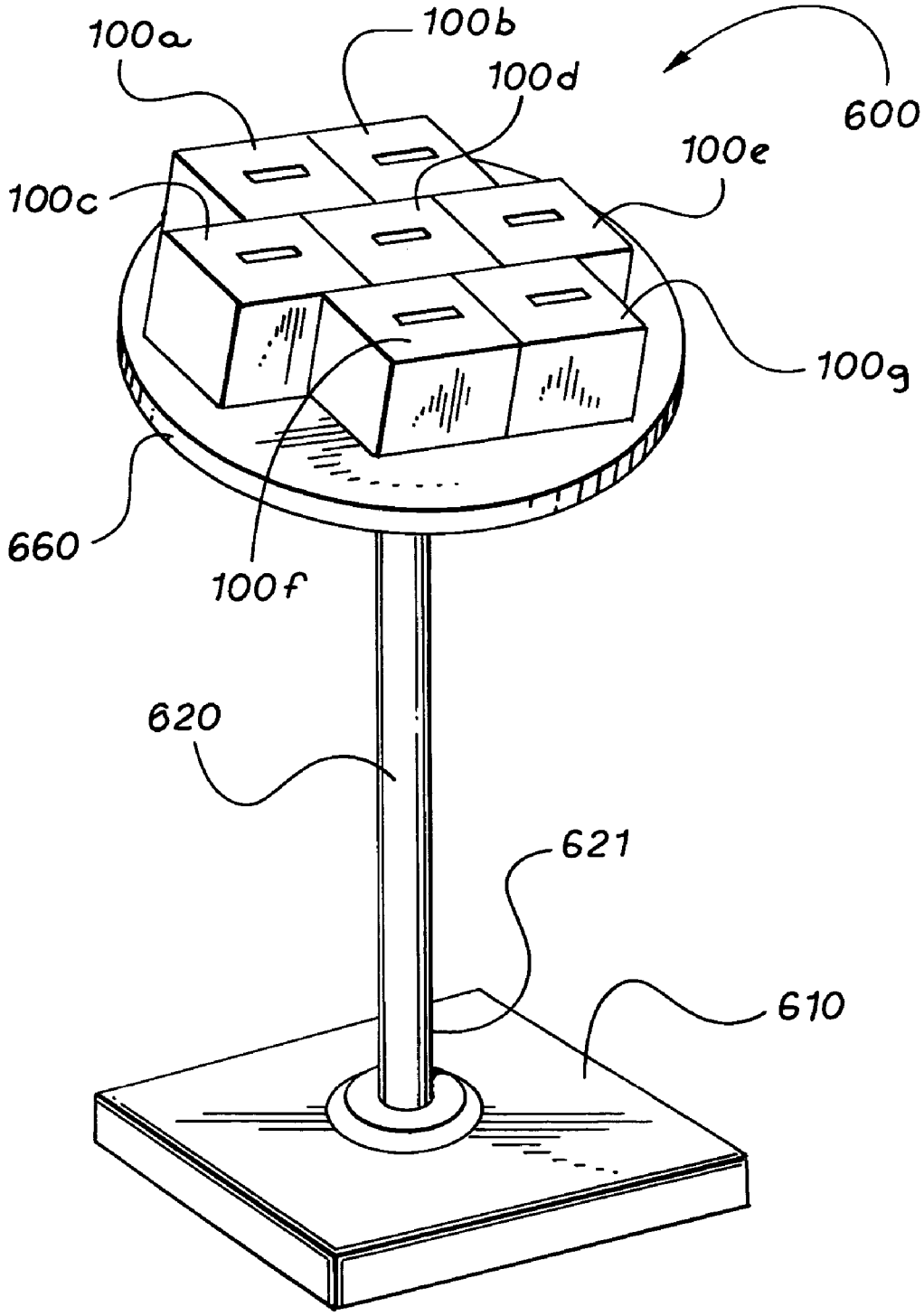
FIG. 6 is a perspective view of a pedestal display, shown with a grouping of ring display modules according to an alternative embodiment of the present version of the invention.

Referring now to FIG. 6, there is illustrated a perspective view of a pedestal style display 600, in accordance with an alternative embodiment of the present invention. As illustrated in FIG. 6, pedestal display 600 preferably comprises base 610, support member 620, and article display platform 660. Base 610 preferably comprises a square-shaped member; however, any shape or configuration may be utilized. Support member 620 is preferably stem like, and includes a first end 621 and a second end 623. Pedestal display 600 preferably holds display units 100*a*, 100*b*, 100*c*, 100*d*, 100*e*, 100*f*, and 100*g* releasably attached to article display platform 660 to form a pedestal style display 600.

In general use, article display unit 100 may selectively comprise one or more surfaces in contact with one or more surfaces of additional article display units 100 and removably attached thereto, or to article display platform 310 or article display platform 660. As such, any article display unit 100 may be temporarily removed and/or magnetically re-adhered to article display platform 310 or article display platform 660, so as to provide any selected configuration of article display set 300 or article display set 600. Additionally, since article display units 100 comprise releasably attaching magnets 121, such enables convenient and expeditious removal or addition of an article display unit 100 from article display set 300 or article display set 600 for presentation of one or more articles 131 retained in article display units 100 to a customer, and further enables practically effortless return of such article display units 100 to the display case, as well as selective rearranging, reorganizing, and/or reordering of article display units 100. Accordingly, the present invention expedites both the article handling and/or re-traying process by enabling the removal, attachment, or re-attachment of article display unit 100 from article display platform 310 or article display platform 660, forming article display set 300 and article display set 600, respectively. Such article handling processes may include, but are not limited to, jewelry display set-up time, jewelry display take-down time, and jewelry display alignment and/or adjustments. Further, if an article is sold, the associated article display unit 100 does not have to be returned to article display set 300 or article display set 600 within the case, but can be removed from article display set 300 or article display set 600, and the remaining article display units 100 rearranged in any selected manner. Still further, if an article 131 is to be added to article display set 300 or article display set 600, the associated article display unit 100 displaying article 131 may be releasably attached to article display platform 310 or article display platform 660, forming article display set 300 or article display set 600, respectively.

In use, article display sets 300, 600 may be used to display article sets as a collection of jewelry items having a particular style, or jewelry items having similar gem stones, grouped together and displayed as a set. Articles 131 may include, but are not limited to, ornamental devices worn by persons, and typically made of stones, precious and semiprecious gems, and metals, and thus include pins, clasp, bracelets, bangles, watches, bracelets, necklaces, rings, and earrings, as well as items such as hair ornaments or body piercing jewelry. It is contemplated that other items can be selectively secured to article display platform 310 or article display platform 660 for display.

Article display platform 310, 660 and article display units 100 may also include indicia formed thereon, including embossing, de-bossing, ink or ink-like materials, labels, or business cards attached by magnets as described above, or by other means such as adhesives or mechanical fasteners. The indicia may include, but is not limited to, a logo, an advertisement, an instruction, a promotion, a company name, a company contact information, and an article name or article set name. Thus, article display set 300, 600, article display units 100, 200, and/or article display platform 310, 660 can be used as a promotional item by including a business name or product logo thereon.

Having thus described exemplary embodiments of the present version of the invention, it should be noted by those skilled in the art that the within disclosures are exemplary only, and that various other alternatives, adaptations, and modifications may be made within the scope of the present version of the invention. Accordingly, the present version of the invention is not limited to the specific embodiments illustrated herein, but is limited only by the following claims.

What is claimed is:

1. An article display set, said article display set comprising:

an article display platform comprising a means for releasably attaching articles directly thereto; and a plurality of article displays, each article display comprising a respective magnet for removably and releasably attaching said article display to the surface of the article display platform and a tacky material disposed proximate an external surface for removably adhering said article display to a second article display.

2. The article display set of claim 1, wherein each said magnet provides a magnetic attraction force that enables each said article display to cling to said article display platform.

3. The article display set of claim 1, wherein each said magnet restricts independent movement between a respective one of said article display and at least one second article display, and said article display platform.

4. The article display set of claim 1, wherein said means for releasably attaching articles comprises a surface that is tacky.

5. The article display set of claim 1, further comprising at least one of an indicia formed integrally with at least one of said article display and said article display platform, and an indicia removably attached to at least one of said article display and said article display platform.

6. The article display set of claim 1, wherein each said magnet is adhered to a bottom of said respective article display.

7. The article display set of claim 1, wherein said article display platform comprises at least one ferromagnetic member proximate a top of said article display platform and wherein said plurality of article displays is removably attached to said top of said article display platform by said respective magnets.

8. The article display set of claim 1, wherein said plurality of article displays are arranged in rows and columns.

9. The article display set of claim 1, wherein each article display of said plurality of article displays further comprises a ring retaining structure.

10. The article display set of claim 1 wherein an article is removably adhered directly to the article display platform.

11. The article display set of claim 1 wherein the articles to be displayed comprise jewelry.

12. A jewelry display set comprising:

a ferromagnetic member at least one jewelry display comprising a ring retaining structure accessible from a top of said jewelry display;

a magnet disposed proximate a bottom of said jewelry display whereby said jewelry display is removably retained proximate the ferromagnetic member by said magnet and said jewelry display comprising a tacky material disposed proximate an external surface for removably adhering said jewelry display to a second jewelry display.

13. The jewelry display of claim 12, wherein said ferromagnetic member comprises a jewelry display platform.

14. The jewelry display of claim 13, wherein an external surface of said jewelry display platform comprises a tacky material for removably adhering at least one of a piece of jewelry and said jewelry display.

15. The jewelry display set of claim 12 further comprising a plurality of jewelry displays and wherein each of the jewelry displays are substantially the same size.

16. The jewelry display set of claim 15 wherein each of the jewelry displays are substantially cube shaped.

17. A method of displaying a plurality of articles comprising the steps of:

retaining each of the articles in an article retaining structure of an article display, each display comprising a magnet and a tacky material disposed proximate an external surface for removably adhering said article display to a second article display;

arranging each of said article displays on an article display platform comprising a ferromagnetic material; and retaining said article displays on said article display platform using said magnets to display the articles.

18. The method of claim 17, further comprising the steps of:

removing at least one said article display from said article display platform, whereby the article retained within the at least one article display may be viewed by a customer.

19. The method of claim 18 further comprising the step of:

rearranging the arrangement of the article displays remaining on the ferromagnetic material.

20. The method of claim 17 wherein the articles are rings.

* * * * *